US008469364B2

(12) United States Patent
Bassett et al.

(10) Patent No.: US 8,469,364 B2
(45) Date of Patent: Jun. 25, 2013

(54) MOVABLE BULLET TRAP

(75) Inventors: David Bassett, Provo, UT (US); James Sovine, Orem, UT (US); Kyle Bateman, Provo, UT (US)

(73) Assignee: Action Target Inc., Provo, UT (US)

( * ) Notice: Subject to any disclaimer, the term of this patent is extended or adjusted under 35 U.S.C. 154(b) by 1752 days.

(21) Appl. No.: 11/745,077

(22) Filed: May 7, 2007

(65) Prior Publication Data

US 2012/0126480 A1 May 24, 2012

Related U.S. Application Data

(60) Provisional application No. 60/798,490, filed on May 8, 2006.

(51) Int. Cl.
*F41J 13/00* (2009.01)

(52) U.S. Cl.
USPC ..... 273/410; 273/407

(58) Field of Classification Search
USPC ..... 273/359, 366, 370, 403–410
See application file for complete search history.

(56) References Cited

U.S. PATENT DOCUMENTS

| | | | | |
|---|---|---|---|---|
| 197,398 | A | 11/1877 | O'Neil | |
| 385,546 | A | 7/1888 | Decumbus | |
| 429,942 | A | 6/1890 | McBride | |
| 570,820 | A * | 11/1896 | Scratton | 273/404 |
| 631,175 | A | 8/1899 | Parnall | |
| 694,581 | A | 3/1902 | Reichlin | |
| 840,610 | A | 1/1907 | Easdale | |
| 879,670 | A | 2/1908 | Petry | |
| 937,733 | A * | 10/1909 | Worrell | 273/404 |
| 941,642 | A | 11/1909 | Maxim | |
| 960,085 | A | 5/1910 | Giles | |
| 980,255 | A | 1/1911 | Herms et al. | |
| 1,035,908 | A | 8/1912 | Richardson | |
| 1,155,717 | A | 10/1915 | Fouts | |
| 1,207,456 | A | 12/1916 | Whelan | |
| 1,348,283 | A | 8/1920 | Koehl | |
| 1,543,605 | A | 6/1925 | Gavard | |
| 1,559,171 | A | 10/1925 | Knowles | |
| 1,657,931 | A | 7/1926 | Krantz | |
| 1,704,731 | A | 3/1929 | Bernhard | |
| 1,728,046 | A | 9/1929 | Duerr | |
| 1,738,874 | A | 12/1929 | Domingo | |
| 1,767,248 | A | 6/1930 | Leach | |

(Continued)

FOREIGN PATENT DOCUMENTS

| | | |
|---|---|---|
| CA | 2100631 | 2/1994 |
| DD | 214 433 | 10/1984 |

(Continued)

OTHER PUBLICATIONS

Caswell International Corp., Bullet Trap Design, Circa 2002.

(Continued)

*Primary Examiner* — Mark Graham
(74) *Attorney, Agent, or Firm* — Bateman IP

(57) ABSTRACT

A portable bullet trap includes a rail which is attachable to a shoot house or other ballistic wall and a trolley which facilitates movement of the bullet trap along the rail. Additionally a bullet trap may include a plurality of pivotable baffles or other structures disposed therein to deflect and partially decelerate a bullet.

18 Claims, 14 Drawing Sheets

U.S. PATENT DOCUMENTS

| | | | | | |
|---|---|---|---|---|---|
| 2,048,155 | A | | 1/1935 | Armantrout | |
| 2,008,359 | A | | 7/1935 | Lamb | |
| 2,013,133 | A | | 9/1935 | Caswell | |
| 2,039,552 | A | | 5/1936 | Reynolds | |
| 2,039,602 | A | | 5/1936 | Luebbe | |
| 2,054,665 | A | | 9/1936 | Tracy | |
| 2,085,933 | A | | 7/1937 | Vaughan | |
| 2,104,171 | A | | 1/1938 | Schwerin | |
| 2,179,471 | A | | 11/1939 | Lee | |
| 2,201,527 | A | | 5/1940 | Freeman | |
| 2,284,510 | A | | 5/1942 | Cates | |
| 2,290,297 | A | * | 7/1942 | Smith | 273/370 |
| 2,344,829 | A | * | 3/1944 | McAvoy | 104/173.1 |
| 2,350,827 | A | | 6/1944 | Saulnier | |
| 2,372,111 | A | | 3/1945 | Norberg | |
| 2,411,026 | A | | 11/1946 | Conner et al. | |
| 2,420,304 | A | | 5/1947 | Diem | |
| 2,538,118 | A | | 6/1949 | Miller | |
| 2,494,210 | A | * | 1/1950 | Robinson | 273/369 |
| 2,518,445 | A | | 8/1950 | Benson | |
| 2,535,280 | A | * | 12/1950 | Gartrell | 273/404 |
| 2,586,958 | A | * | 2/1952 | Keller | 273/406 |
| 2,587,042 | A | | 2/1952 | Haiselup | |
| 2,613,934 | A | | 10/1952 | Tabler | |
| 2,631,454 | A | | 3/1953 | Shepard et al. | |
| 2,670,959 | A | | 3/1954 | Broyles | |
| 2,706,634 | A | | 4/1955 | Van Valkenburg | |
| 2,713,262 | A | | 7/1955 | Webster | |
| 2,772,092 | A | | 11/1956 | Nikoden | |
| 2,819,903 | A | | 1/1958 | Saunders | |
| 2,838,309 | A | * | 6/1958 | Merz et al. | 273/406 |
| 2,905,469 | A | | 9/1959 | Taylor | |
| 3,014,725 | A | | 12/1961 | Lewis | |
| 3,032,808 | A | | 5/1962 | Fleming | |
| 3,087,701 | A | | 4/1963 | Wallace | |
| 3,103,362 | A | | 9/1963 | Elofson | |
| 3,113,773 | A | | 12/1963 | Ripepe | |
| 3,140,874 | A | * | 7/1964 | Jensen et al. | 273/369 |
| 3,265,226 | A | | 8/1966 | Malcolm | |
| 3,300,032 | A | | 1/1967 | Lucien | |
| 3,348,843 | A | | 10/1967 | Stanley | |
| 3,363,900 | A | * | 1/1968 | Cadle | 273/359 |
| 3,385,405 | A | | 5/1968 | Cullen | |
| 3,392,980 | A | | 7/1968 | Ortega | |
| 3,404,887 | A | | 10/1968 | Dundr | |
| 3,422,538 | A | | 1/1969 | Panissidi | |
| 3,447,806 | A | | 6/1969 | Pfaff et al. | |
| 3,471,153 | A | * | 10/1969 | Baumler | 273/359 |
| 3,508,302 | A | | 4/1970 | Settanni | |
| 3,510,133 | A | * | 5/1970 | Gretzky | 273/404 |
| 3,515,388 | A | | 6/1970 | Zachmeier | |
| 3,540,729 | A | | 11/1970 | Rahberger | |
| 3,567,223 | A | | 3/1971 | Gentiluomo | |
| 3,601,353 | A | | 8/1971 | Dale | |
| 3,614,102 | A | * | 10/1971 | Nikoden, Sr. | 273/406 |
| 3,673,294 | A | | 6/1972 | Matthaei | |
| 3,701,532 | A | | 10/1972 | Nikoden | |
| 3,737,165 | A | | 6/1973 | Pencyla | |
| 3,802,098 | A | | 4/1974 | Sampson et al. | |
| 3,914,879 | A | | 10/1975 | Taylor, III | |
| 3,982,761 | A | | 9/1976 | DeVogelaere | |
| 3,992,007 | A | | 11/1976 | Seeman | |
| 4,072,313 | A | * | 2/1978 | Murso et al. | 273/359 |
| 4,076,247 | A | | 2/1978 | Kim et al. | |
| 4,084,299 | A | | 4/1978 | Noda | |
| 4,086,711 | A | | 5/1978 | Gammarino et al. | |
| 4,126,311 | A | | 11/1978 | Wagoner | |
| 4,177,835 | A | | 12/1979 | Paley | |
| 4,205,847 | A | | 6/1980 | Steiger et al. | |
| 4,228,569 | A | | 10/1980 | Snyder | |
| 4,232,867 | A | | 11/1980 | Tate, Sr. | |
| 4,272,078 | A | | 6/1981 | Vinette | |
| 4,288,080 | A | | 9/1981 | Laporte et al. | |
| 4,294,452 | A | | 10/1981 | Schlotter et al. | |
| 4,317,572 | A | | 3/1982 | Iseli | |
| 4,340,370 | A | | 7/1982 | Marshall et al. | |
| 4,361,330 | A | | 11/1982 | Scharer | |
| 4,395,045 | A | | 7/1983 | Baer | |
| 4,440,399 | A | | 4/1984 | Smith | |
| 4,445,693 | A | | 5/1984 | Angwin | |
| 4,458,901 | A | | 7/1984 | Wojcinski | |
| 4,479,048 | A | | 10/1984 | Kinoshita | |
| 4,501,427 | A | | 2/1985 | Payne | |
| 4,506,416 | A | | 3/1985 | Ohminato et al. | |
| 4,509,301 | A | | 4/1985 | Head | |
| 4,512,585 | A | | 4/1985 | Baravaglio | |
| 4,540,182 | A | | 9/1985 | Clement | |
| 4,546,984 | A | | 10/1985 | Towle et al. | |
| 4,589,792 | A | | 5/1986 | Niziol | |
| 4,598,631 | A | | 7/1986 | Everett | |
| 4,614,345 | A | | 9/1986 | Doughty | |
| 4,638,546 | A | | 1/1987 | Benshoof | |
| 4,657,261 | A | | 4/1987 | Saunders | |
| 4,677,798 | A | | 7/1987 | Phillips | |
| 4,683,688 | A | | 8/1987 | Wojcinski | |
| 4,691,925 | A | | 9/1987 | Scholem | |
| 4,706,963 | A | | 11/1987 | Geuss | |
| 4,717,308 | A | | 1/1988 | Kuhns | |
| 4,726,593 | A | | 2/1988 | Wade | |
| 4,728,109 | A | | 3/1988 | Simonetti | |
| 4,739,996 | A | | 4/1988 | Vedder | |
| 4,743,032 | A | | 5/1988 | Summers et al. | |
| 4,786,059 | A | | 11/1988 | Barini | |
| 4,787,289 | A | | 11/1988 | Duer | |
| 4,819,946 | A | | 4/1989 | Kahler | |
| 4,821,620 | A | | 4/1989 | Cartee et al. | |
| 4,844,476 | A | | 7/1989 | Becker | |
| 4,846,043 | A | | 7/1989 | Langsam | |
| 4,856,791 | A | | 8/1989 | McQuade | |
| 4,890,847 | A | * | 1/1990 | Cartee et al. | 273/406 |
| 4,898,391 | A | | 2/1990 | Kelly et al. | |
| 4,911,453 | A | | 3/1990 | Essex et al. | |
| 4,913,389 | A | | 4/1990 | McCracken | |
| 4,919,437 | A | | 4/1990 | Salabé et al. | |
| 5,006,995 | A | | 4/1991 | Toschi et al. | |
| 5,040,802 | A | | 8/1991 | Wojcinski et al. | |
| 5,054,723 | A | | 10/1991 | Arnold | |
| 5,070,763 | A | | 12/1991 | Coburn | |
| 5,085,765 | A | | 2/1992 | Salabé et al. | |
| 5,088,741 | A | | 2/1992 | Simonetti | |
| 5,113,700 | A | | 5/1992 | Coburn | |
| 5,121,671 | A | | 6/1992 | Coburn | |
| D329,680 | S | | 9/1992 | Burn | |
| 5,145,133 | A | | 9/1992 | France | |
| 5,163,689 | A | | 11/1992 | Bateman et al. | |
| 5,171,020 | A | | 12/1992 | Wojcinski | |
| 5,242,172 | A | * | 9/1993 | Bateman | 273/369 |
| 5,255,924 | A | | 10/1993 | Copius | |
| 5,259,291 | A | | 11/1993 | Wilson | |
| 5,263,721 | A | | 11/1993 | Lowrance | |
| 5,316,479 | A | | 5/1994 | Wong et al. | |
| 5,324,043 | A | | 6/1994 | Estrella | |
| 5,333,557 | A | | 8/1994 | Eickhoff | |
| 5,340,117 | A | | 8/1994 | Wojcinski | |
| 5,346,226 | A | | 9/1994 | Block | |
| 5,350,180 | A | | 9/1994 | Acock | |
| 5,352,170 | A | | 10/1994 | Condo et al. | |
| 5,361,455 | A | | 11/1994 | Kiefer | |
| 5,367,860 | A | | 11/1994 | Cullen | |
| 5,400,692 | A | | 3/1995 | Bateman et al. | |
| 5,405,673 | A | | 4/1995 | Seibert | |
| 5,433,451 | A | | 7/1995 | De Vries | |
| 5,435,571 | A | | 7/1995 | Wojcinski et al. | |
| 5,441,280 | A | | 8/1995 | Copius | |
| 5,443,352 | A | | 8/1995 | Schuhmacher | |
| 5,456,155 | A | | 10/1995 | Myrtoglou | |
| 5,486,008 | A | | 1/1996 | Coburn | |
| 5,535,662 | A | | 7/1996 | Bateman et al. | |
| 5,542,616 | A | | 8/1996 | Archer | |
| 5,564,712 | A | | 10/1996 | Werner | |
| 5,598,996 | A | | 2/1997 | Rath | |
| 5,605,335 | A | * | 2/1997 | Simpson | 273/406 |
| 5,607,163 | A | | 3/1997 | Nesler | |
| 5,618,044 | A | | 4/1997 | Bateman | |
| 5,621,950 | A | | 4/1997 | White | |
| 5,636,995 | A | | 6/1997 | Sharpe, III et al. | |
| 5,641,288 | A | | 6/1997 | Zaenglein, Jr. | |

| | | | | |
|---|---|---|---|---|
| 5,648,794 | A | | 7/1997 | Jelsma et al. |
| 5,649,706 | A | | 7/1997 | Treat, Jr. et al. |
| 5,655,775 | A | | 8/1997 | Pontus et al. |
| 5,676,378 | A | | 10/1997 | West |
| 5,715,739 | A | | 2/1998 | White |
| 5,718,434 | A | * | 2/1998 | Alward ..... 273/410 |
| 5,738,593 | A | | 4/1998 | Coury et al. |
| 5,749,177 | A | * | 5/1998 | Pontus et al. ..... 52/79.1 |
| 5,765,832 | A | | 6/1998 | Huff |
| 5,802,460 | A | | 9/1998 | Parvulescu et al. |
| 5,811,164 | A | | 9/1998 | Mitchell |
| 5,811,718 | A | | 9/1998 | Bateman et al. |
| 5,822,936 | A | | 10/1998 | Bateman et al. |
| 5,829,753 | A | | 11/1998 | Wiser |
| 5,848,794 | A | | 12/1998 | Wojcinski et al. |
| 5,865,439 | A | | 2/1999 | Marcuson |
| 5,901,960 | A | | 5/1999 | Nesler et al. |
| 5,906,552 | A | | 5/1999 | Padilla |
| 5,907,930 | A | * | 6/1999 | Ricco, Sr. ..... 52/79.1 |
| 5,934,678 | A | | 8/1999 | Theissen et al. |
| 5,947,477 | A | | 9/1999 | Turnipseed |
| 5,950,283 | A | | 9/1999 | Sato |
| 5,951,016 | A | | 9/1999 | Bateman |
| 5,963,624 | A | | 10/1999 | Pope |
| 5,967,523 | A | | 10/1999 | Brownlee |
| 5,988,645 | A | | 11/1999 | Downing |
| 6,000,700 | A | | 12/1999 | Nesler et al. |
| 6,016,735 | A | | 1/2000 | Langner |
| 6,018,847 | A | | 2/2000 | Lu |
| 6,027,120 | A | | 2/2000 | Wojcinski et al. |
| 6,109,614 | A | | 8/2000 | Ciarcia |
| 6,162,057 | A | | 12/2000 | Westphal et al. |
| 6,173,956 | B1 | | 1/2001 | O'Neal |
| 6,223,029 | B1 | | 4/2001 | Stenman et al. |
| 6,230,214 | B1 | | 5/2001 | Liukkonen et al. |
| 6,245,822 | B1 | | 6/2001 | Terada et al. |
| 6,268,590 | B1 | | 7/2001 | Gale et al. |
| 6,283,756 | B1 | | 9/2001 | Danckwerth et al. |
| 6,289,213 | B1 | | 9/2001 | Flint et al. |
| 6,293,552 | B1 | | 9/2001 | Wojcinski et al. |
| 6,308,062 | B1 | | 10/2001 | Chien et al. |
| 6,311,980 | B1 | | 11/2001 | Sovine et al. |
| 6,322,444 | B1 | | 11/2001 | Matsui et al. |
| 6,325,376 | B1 | | 12/2001 | Elliott et al. |
| 6,328,651 | B1 | | 12/2001 | Lebensfeld et al. |
| 6,332,243 | B1 | | 12/2001 | Kim |
| 6,341,708 | B1 | | 1/2002 | Palley et al. |
| 6,350,197 | B1 | | 2/2002 | Cooksey et al. |
| 6,363,867 | B1 | | 4/2002 | Tsilevich |
| 6,378,870 | B1 | | 4/2002 | Sovine et al. |
| 6,398,215 | B1 | | 6/2002 | Carroll |
| 6,415,557 | B1 | | 7/2002 | McCalley |
| 6,463,299 | B1 | | 10/2002 | Macor |
| 6,478,301 | B1 | | 11/2002 | Witmeyer |
| 6,484,990 | B1 | | 11/2002 | Marshall et al. |
| 6,502,820 | B2 | | 1/2003 | Slifko |
| 6,533,280 | B1 | | 3/2003 | Sovine et al. |
| 6,543,778 | B2 | | 4/2003 | Baker |
| 6,575,753 | B2 | | 6/2003 | Rosa et al. |
| 6,588,759 | B1 | | 7/2003 | Bateman et al. |
| 6,679,795 | B2 | | 1/2004 | Ouimette et al. |
| 6,718,596 | B2 | | 4/2004 | Kohlstrand et al. |
| 6,728,546 | B1 | | 4/2004 | Peterson et al. |
| RE38,540 | E | | 6/2004 | Bateman |
| 6,761,357 | B2 | | 7/2004 | Witt |
| 6,776,418 | B1 | | 8/2004 | Sovine et al. |
| 6,808,177 | B2 | | 10/2004 | Dehart |
| 6,808,178 | B1 | | 10/2004 | Sovine et al. |
| 6,896,267 | B1 | | 5/2005 | Le Anna |
| 6,975,859 | B1 | | 12/2005 | Lambert et al. |
| 6,994,347 | B2 | | 2/2006 | Tessel et al. |
| 6,994,348 | B2 | | 2/2006 | Lambert et al. |
| 6,994,349 | B2 | | 2/2006 | Lambert et al. |
| 7,134,977 | B2 | | 11/2006 | Campbell et al. |
| 7,140,615 | B1 | | 11/2006 | Sovine et al. |
| 7,175,181 | B1 | | 2/2007 | Bateman et al. |
| 7,194,944 | B2 | | 3/2007 | Lambert et al. |
| 7,219,897 | B2 | | 5/2007 | Sovine et al. |
| 7,234,890 | B1 | | 6/2007 | Marshall et al. |
| 7,264,246 | B2 | | 9/2007 | Sovine et al. |
| 7,275,748 | B2 | | 10/2007 | Lambert et al. |
| 7,303,192 | B2 | | 12/2007 | Marshall et al. |
| 7,306,230 | B2 | | 12/2007 | Lambert et al. |
| 7,322,771 | B1 | | 1/2008 | Marshall et al. |
| 2004/0034984 | A1 | | 2/2004 | Aoki et al. |
| 2005/0022658 | A1 | | 2/2005 | Bateman et al. |
| 2006/0234069 | A1 | | 10/2006 | Sovine et al. |
| 2006/0240388 | A1 | | 10/2006 | Marshall et al. |
| 2006/0240391 | A1 | | 10/2006 | Sovine et al. |
| 2007/0040334 | A1 | | 2/2007 | Marshall et al. |
| 2007/0045965 | A1 | | 3/2007 | Bateman et al. |
| 2007/0069472 | A1 | | 3/2007 | Lambert et al. |
| 2007/0072537 | A1 | | 3/2007 | Bateman et al. |
| 2007/0102883 | A1 | | 5/2007 | Parks et al. |
| 2007/0114724 | A1 | | 5/2007 | Bassett et al. |
| 2007/0235943 | A1 | | 10/2007 | Bateman et al. |
| 2008/0022847 | A1 | | 1/2008 | Bateman et al. |

FOREIGN PATENT DOCUMENTS

| | | | |
|---|---|---|---|
| DE | 20 21 170 | | 11/1971 |
| DE | 32 12 781 | | 10/1983 |
| DE | 36 35 741 | | 7/1992 |
| EP | 0 399 960 | | 11/1990 |
| EP | 0 523 801 | | 1/1993 |
| EP | 528722 | A1 | 2/1993 |
| GB | 6353 | | 0/1909 |
| GB | 2136932 | | 9/1984 |
| GB | 2 187 270 | | 9/1987 |
| GB | 2 242 730 | | 10/1991 |
| JP | 05241275 | A | 9/1993 |
| JP | 10339093 | A | 12/1998 |
| WO | WO 85-05672 | | 12/1985 |
| WO | WO 94-27111 | | 11/1994 |

OTHER PUBLICATIONS

Caswell International Corp., Bullet Trap Product Literature, Circa 2002.
Caswell International Corp., Product Literature, Copyright 2002.
Declaration of Kyle Bateman re Bullet Trap Design Circa 2001.
Duelatron, Product Literature 1995.
www.letargets.com. Breach training door. Circa 2005.
www.mgmtargets.com. Breach training door Circa 2005.
Porta Target, Product Literature, Circa 2000.
Porta Target, Shoot House Product Literature, Circa 2000.
Savage Arms, Shoot House Bid and Specification, Bid dated Oct. 1998.
ST Bullet Containment Sytems, Inc. Product Literature, Circa 2002.
Trussed Concrete Steel Co., Youngstown, Ohio, Copyright 1903, Product Literature.
Law Enforcement Targets, Inc., Product Literature, Jul. 8, 2003.
Law Enforcement Targets, Inc., Product Literature, Oct. 12, 2004.
Law Enforcement Targets, Inc., Product Literature, Jun. 26, 2007.
Metal Spinning Target, Inc., Dueling Trees, Jul. 8, 2003.
Mike Gibson Manufacturing Tree, Jul. 8, 2003.
Outwest Mfg. Products, Product Literature, Jul. 8, 2003.
Shootrite, Tactical Training Target, published prior to Apr. 4, 2005.
U.S. Appl. No. 10/287,191, filed Nov. 4, 2002, Bateman et al.
U.S. Appl. No. 11/494,788, filed Jul. 26, 2006, Bateman et al.
U.S. Appl. No. 11/349,739, filed Feb. 8, 2006, Bateman et al.
U.S. Appl. No. 11/349,738, filed Feb. 8, 2006, Bateman et al.
U.S. Appl. No. 11/506,763, filed Aug. 18, 2006, Bateman et al.
U.S. Appl. No. 11/506,413, filed Aug. 17, 2006, Wright et al.
U.S. Appl. No. 11/530,280, filed Sep. 8, 2006, Marshall et al.
U.S. Appl. No. 11/781,187, filed Jul. 20, 2007, Bateman et al.

* cited by examiner

MOVABLE BULLET TRAP

RELATED APPLICATIONS

The present application claims the benefit of U.S. Provisional Application Ser. No. 60/798,490, filed May 8, 2006, which is expressly incorporated herein in its entirety.

BACKGROUND OF THE INVENTION

1. The Field of the Invention

The present invention relates to a movable bullet trap for use in a shoot house or other environment so as to prolong the life of the shoot house, etc. More specifically, the present invention relates to a movable bullet trap for use in high shooting density environments.

2. State of the Art

One of the most dangerous situations for a police officer or other law enforcement official is responding to a domestic disturbance or other call that involves entry into an apartment or house. A substantial percentage of all officers killed in the line of duty are killed while responding to domestic disturbances and other situations which require the officer to enter a home while occupants are present. The officers are often killed by a jealous husband, a boyfriend or other occupant of the home.

Likewise, one of the most dangerous environments for military personnel is urban warfare. In such a situation, military personnel often have to clear the house room by room to ensure that there are no terrorists or combatants hiding in the house. This is very different from battlefield conditions where the enemy can usually be seen and where explosives can be used with minimal risk to civilians.

Proper training of law enforcement officers and military personnel provides a marked improvement in reaction time and protocol in properly clearing a house. To this end shoot houses have been developed which provide officers with the ability to train with 360 degree live fire in a bullet trap that resembles the inside of house. The officer, soldier, etc., can enter a room to find nothing, an innocent bystander, and/or a target resembling an armed person posing a threat.

In many situations, the firing in a shoot house will tend to have fairly high density in the area surrounding the target representing the threat. In a scenario where a large number of officers or military personnel are being trained, hundreds or even thousands of rounds may be fired at one general area of a room of the shoot house. This firing can take a significant toll on destructible portions of the shoot house and cause training to stop while the shoot house is repaired.

To resolve these concerns, portable bullet traps, such as that generally indicated at 4 in FIG. 1A, have been developed. The trap 4 includes a box 8 which is made from plate steel or other bullet proof material forming a frame with a plate steel backing. The box 8 is attached to a pair of arms 12 to raise it to the desired height. One side is left open. The opening is covered with a facing material (not shown in FIG. 1A), such as plywood, particle board, plastic sheets, etc. The target representing the threat is mounted on or in front of the facing material 12 so that bullets fired by law enforcement officials, etc., that strike the target pass through the facing material and are contained in the steel box 8.

One disadvantage of the portable traps 4 is that they are relatively heavy. A portable target 4 having an opening which is 2 ft.×3 ft. can easily weigh nearly 200 lbs. Thus it is difficult to move the target to a different desired location. For this reason, the target is often left in one place during training. Using a target in a specific location too long during training can be undesirable because it preconditions the officer or soldier and causes them to act based on prior scenarios, rather than on the instant scenario.

In an attempt to resolve these concerns, bullet traps have been developed, such as shown in FIG. 1B, in which the trap 4' is placed on a stand 20. The bottom of the stand 20 has wheels 24 which allow the target to be rolled from one position to another. Stand 20 makes relocating the target much easier. However, in order to avoid the trap tipping over during shooting, the stand 20 must have a relatively broad base. This requires the target to be placed out as much as 2-3 ft. from the shoot house wall. Because of the expense in constructing a shoot house, many rooms in a shoot house are relatively small and space is at a premium. In a small room, a target attached to the facing material 30 may be only a few feet from the entrance and cannot be easily placed in a corner where a threat might hide. Thus, it is often desirable to have the target as close to the wall as possible.

Still another concept in portable traps is shown in FIG. 1C. Frustrated by the loss of space caused by rolling targets, some law enforcement training facilities have actually cut off the stand and hung the target 4 from the wall of the shoot house by metal braces 34 and the like. While such configuration adds space, it requires a substantial amount of effort to move the target to another location. Additionally, depending on the configuration of the attachment of the braces 34, it may prevent a trap from being placed in a corner of the shoot house if desired.

Thus there is a need for an improved portable trap for use in shoot houses, and the like, and for a system for facilitating the movability of the trap. Such a trap should be relatively simple to use and relatively inexpensive.

Additionally, there is a need for a portable target which improves bullet deceleration.

SUMMARY OF THE INVENTION

It is an object of the present invention to provide an improved bullet trap.

The above and other objects of the invention are obtained with a portable bullet trap which may be mounted to a shoot house or other similar structure so as to allow the trap to be slid along the wall. In accordance with one aspect of the invention, the portable trap is connected to a rail which can be added to and removed from a shoot house to allow the portable trap to be repositioned by sliding along the rail.

In accordance with one aspect of the invention, the rail is part of a rail system which is releasably attachable to the shoot house so that the rail system can be attached to and removed from the shoot house without the use of tools.

In accordance with another aspect of the invention, the rail system can be attached to the shoot house so that rails are present on both sides of a shoot house wall.

Still yet other aspects of the invention relate to the use an improved portable trap wherein a plurality of louvers or other deflection devices are used to provide initial deceleration and deflection to the bullet to thereby allow the use of higher powered rounds without damaging the bullet trap.

In accordance with still yet another aspect of the invention, the bullet trap can be attached to the shoot house in such a way that the vertical position of the trap can be readily adjusted.

BRIEF DESCRIPTION OF THE DRAWINGS

Various embodiments of the present invention are shown and described in reference to the numbered drawings wherein.

It will be appreciated that the drawings are illustrative of various aspects of the present invention and do not limit the scope of the invention, which is defined by the appended claims. Numerous modifications may be made without departing from the scope of the claims.

DETAILED DESCRIPTION

The drawings will now be discussed in reference to the numerals provided therein so as to enable one skilled in the art to practice the present invention. The drawings and descriptions are exemplary of various aspects of the invention and are not intended to narrow the scope of the appended claims. It will also be appreciated that various aspects of the invention may be discussed or shown separately but may be coupled with other aspects of the invention in a single embodiment. Furthermore, it will be appreciated that various embodiments will achieve various aspects of the invention and these aspects should not be viewed as limiting the appended claims.

Figure 1A:
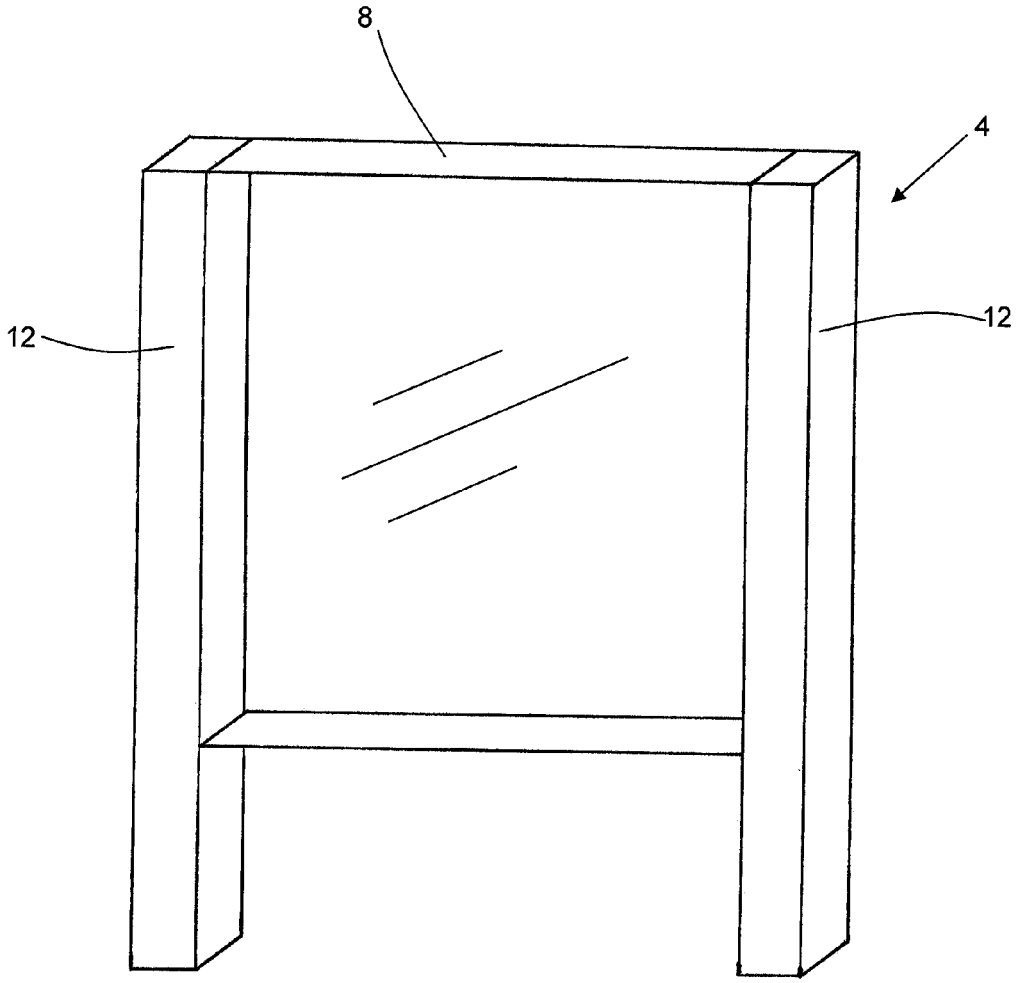
FIG. 1A (Prior Art)
FIG. 1A shows a portable bullet trap formed in accordance with the teachings of the prior art.
Figure 1B:
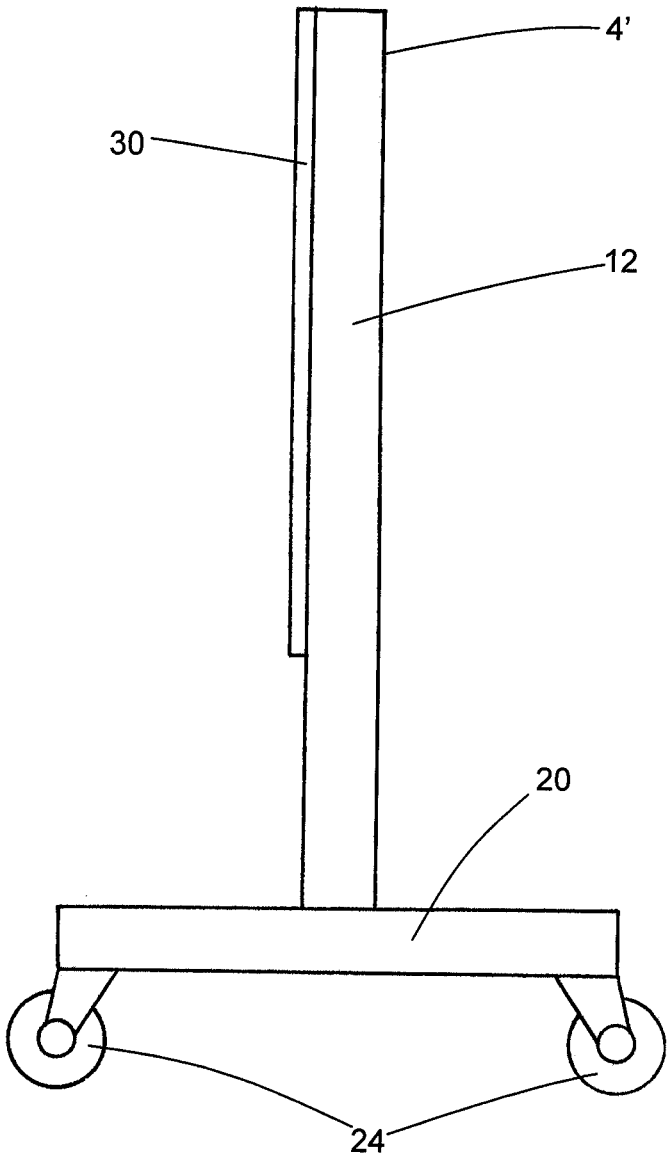
FIG. 1B (Prior Art)
FIG. 1B shows a side view of another portable bullet trap formed in accordance with the teachings of the prior art.
Figure 1C:
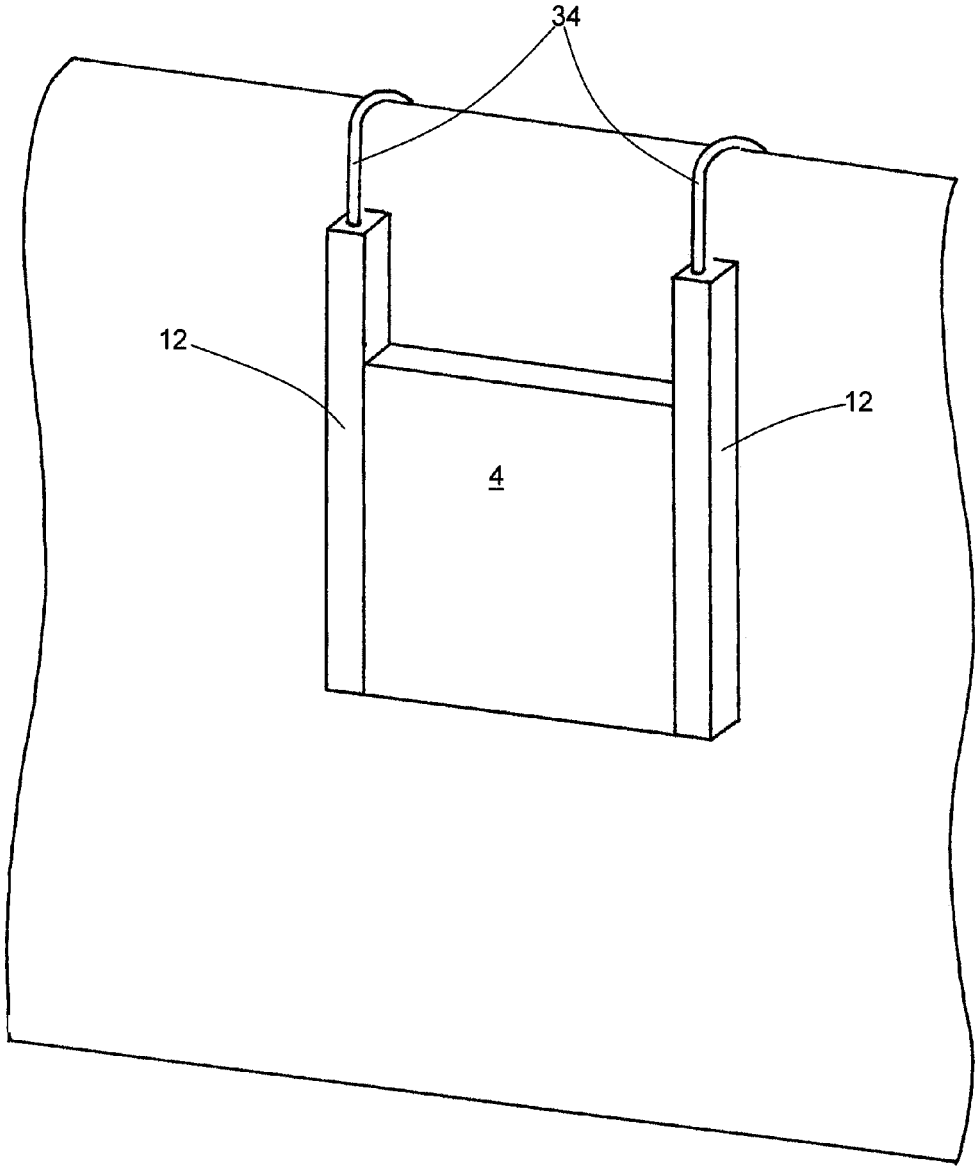
FIG. 1C (Prior Art)
FIG. 1C shows still another view of a bullet trap formed in accordance with the principles of the prior art.
Figure 2:
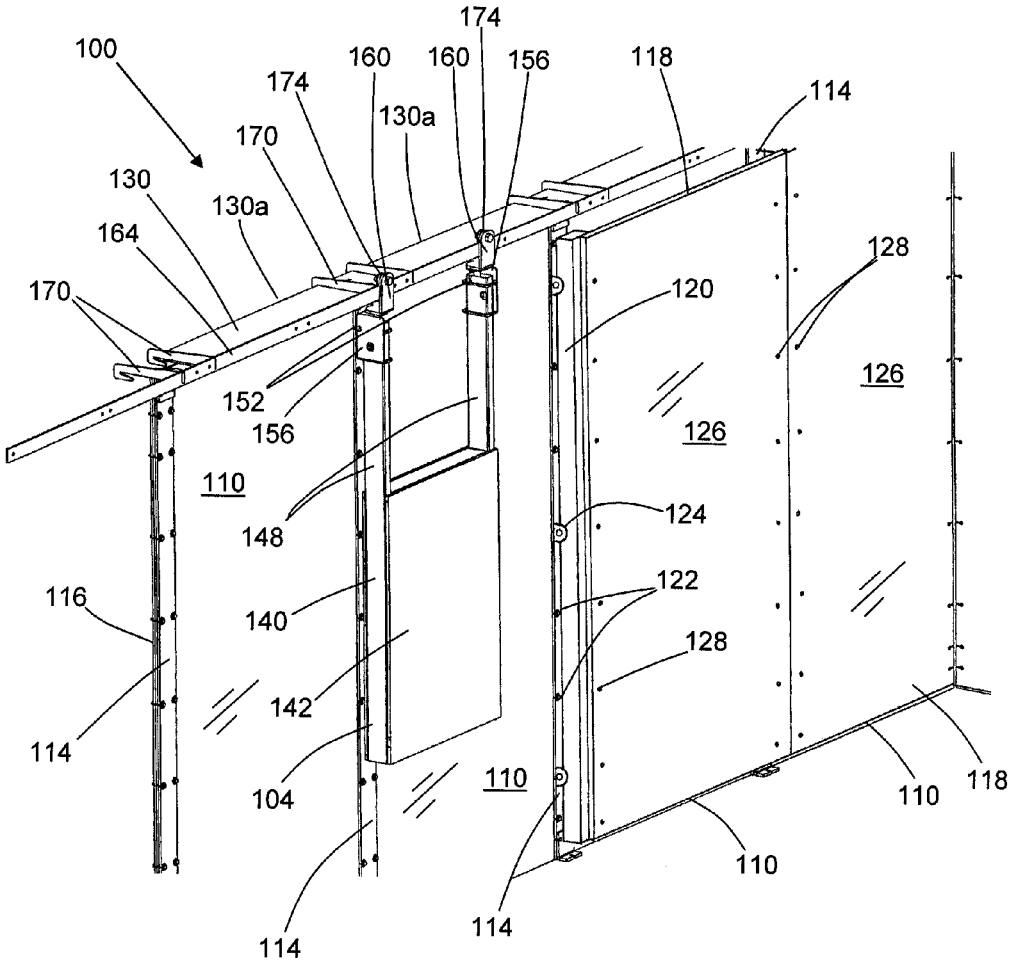
FIG. 2 shows a close-up, fragmented partially cutaway view of a shoot house with a portable trap and rail system formed in accordance with the principles of the present invention.

Turning now to FIG. 2, there is shown a fragmented, partially cutaway view of a wall, generally indicated at 100, of a shoot house (or other structure at a shooting range) and a bullet trap 104 made in accordance with the principles of the present invention. In discussing FIG. 2 and the following figures, many structures (such as nuts, bolts, etc.) are repeatedly used in the figures. For clarity, not every such structure is numbered and specifically discussed, but unnumbered structures are understood to be the same structure or similar to other similarly drawn structures. The shoot house wall 100 is formed by a plurality of steel plates 110 which are placed adjacent one another. Facing strips 114 are used to attach the plates 110 together. Backing strips 116 are usually disposed on the opposing side of the plates 110 from the facing strips 114 to help hold the plates in place. (Those skilled in the art will appreciate that a facing strip may also be a backing strip, and vice versa, when viewed from the opposing side of the wall.)

A bullet containment mechanism 118 is disposed in front of the steel plates 110 and the facing strips 114 to prevent ricochet of a bullet back toward the shooter. (The bullet containment mechanism is not present in front of the first two plates 110 to show the interior structure.) Typically the bullet containment mechanism 118 is formed by spacers 120, such as two-by-fours, steel studs, or some other spacers, which are attached to the facing strips via the bolts 122, by brackets 124 or by other means. The bullet containment mechanism 118 also includes a facing material 126, such as plywood, particle board, sheetrock, etc. which is attached to the two-by-fours by a fastener 128, such as screw, staples, etc. The facing material 126 extends between the two-by-fours 122, etc., to cover the plates 110. While bullets have sufficient force to pass through the facing material 126, the bullets will decelerate and often fragment when they impact the steel plates 110. The smaller, decelerated fragments will usually not have sufficient energy to pass back through the wood and will not be at a proper angle to ricochet back toward the shooter. Those skilled in the art will appreciate that there are numerous methods for forming a shoot house. A few configurations are discussed in U.S. Pat. No. 5,822,936, and U.S. Patent Application Publication Number 2005/0022658, which are expressly incorporated herein.

The shoot house wall 100 shown in FIG. 2 also includes a cap piece 130. The cap piece 130 is beneficial as it limits the ability of a bullet fragment to pass out of the top of the shoot house wall. Typically the cap piece 130 is made from steel plate which is 6 inches to 12 inches wide so that it extends out at least as far from the plates as the facing material 126.

In accordance with the present invention, a portable trap 104 is also shown. The trap 104 is formed by a box structure 140 made of a plate steel frame and backing, or of other suitable material. The metal box 140 will typically have a depth of two to four inches and will be open on one side. In use, the open front side of the box 140 is covered with a piece of plywood 142 so that a bullet will pass through the plywood and then be deflected/decelerated by the back wall and frame of the box. A target may be taped, tacked, pinned, etc., to the plywood, thereby making a portable trap which is functionally very similar to the walls of a shoot house, and which also serves as a target in the shoot house. By shooting into the portable trap 104, less wear and tear is placed on the shoot house wall 100. Additionally replacing the plywood 142 (or other facing material) on the portable trap 104 is much easier than replacing the two-by-fours and plywood of the shoot house 100. Thus, portable traps have been used in shoot houses as an effective method for minimizing wear in high density shooting areas as mentioned in the background section above.

The portable trap 104 shown in FIG. 2 is different than previously used portable traps discussed in the background section, because the trap is much easier to move and can be positioned immediately adjacent a shoot house wall. The portable trap 104 includes a pair of arms 148 which extend upwardly from the box 140. The arms 148 are typically made of wood, but can be made of metal or other materials that provide that adequate ricochet protection.

Each arm 148 is attached to a trolley 152. The trolley includes a mounting portion 156 for engaging the arms 148 of the portable trap 104, and a hanger portion 160 for engaging a rail 164. For reasons which will be explained below, it is preferable that the mounting portion 156 and the hanger portion 160 are pivotably or rotatably attached to one another.

This can be accomplished by both portions 156 and 160 being attached by a bolt provided with washers or left sufficiently loose that the relative rotation is provided between the two portions. It can also be provided by springs or a variety of other mechanisms which would allow the hanger portion 160 to pivot or rotate relative to the arm 148 of the portable trap 140.

Figure 3:
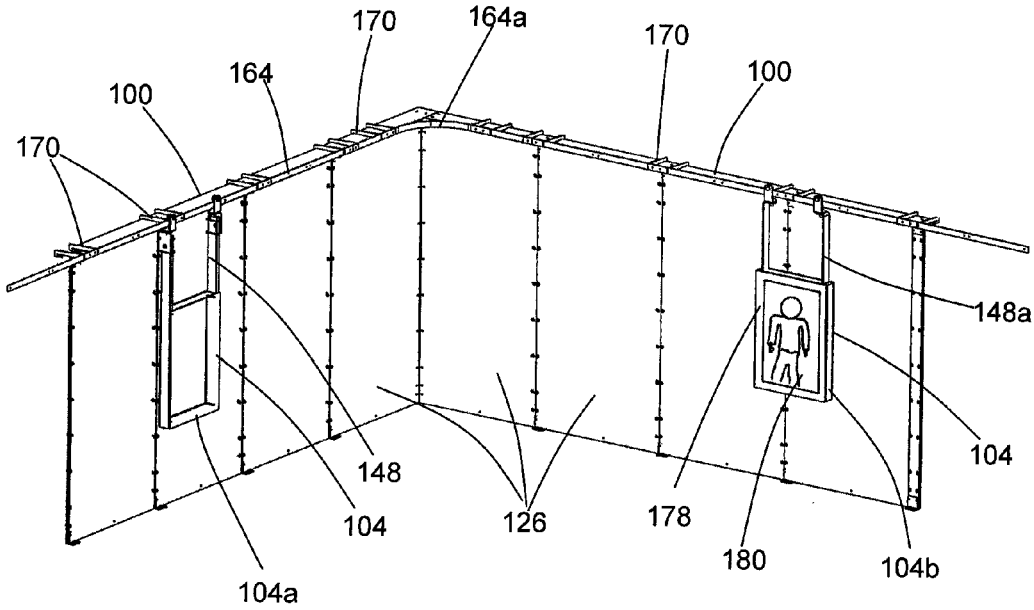
FIG. 3 shows a shoot house, such as that shown in FIG. 2, with a pair of portable bullet traps and a rail system for moving the portable bullet traps along the walls of the shoot house in accordance with the principles of the present invention.

The rail 164 is attached to the shoot house wall 100. As shown in FIG. 3, the rail 164 is attached to the cap piece 130, which is bolted to the facing strips 114. The rail 164 could be attached to the cap piece 130 directly by bolts, screws, etc., or can be attached in a number of other manners. For example, in FIG. 2, the rail 164 is attached to a plurality of releasable hooks 170 by bolts or other convenient fastening mechanisms. The releasable hooks 170 are configured to engage the opposing side 130*a* of the cap piece 130 and to receive the cap piece so that the hooks are held securely in position. Because the hooks 170 are not bolted or otherwise attached to the shoot house wall 100 by tools, the rail 164 can readily be attached to the shoot house or removed to quickly adapt the shoot house wall 100 to the desired configuration. To attach the rail 164, the user need merely slide the hooks 170 over the opposing edge 130*a* and release the hooks so that they rest on the cap piece 130.

The hanger portion 160 of each trolley 152 contains a wheel 174 which engages the rail 164 (typically by a groove in the wheel configured to receive the rail). The wheel 174 allows the portable trap 104 to slide to a desired location. Despite weighing nearly 200 pounds, the portable trap 104 can be easily moved into the desired position with one hand. Thus, the risk of lifting injuries is virtually eliminated. Furthermore, the bullet trap 104 rests right next to the facing material 126, thereby avoiding the waste of space common with wheel mounted portable traps. Additionally, if a particular area will receive a very high volume of fire, several traps 104 can be placed on the rail 164 next to each other, or a replacement trap can be moved into position once trap 104 is full or is no longer safe to shoot on. If needed, the portable trap 104 can be removed by simply lifting the trap until the wheels 174 lift off the rail. Thus, a trap can be moved between rooms if desired. Likewise, the rail 164 can be lifted and pushed rearward so that the hooks 170 disengage the cap piece 130 to easily remove the rail from the shoot house. In a matter of minutes, the rails can then be relocated to another room for use as desired.

Tuning now to FIG. 3, there is shown a perspective view of two walls 100 of a shoot house. The walls 100 are made generally in the same manner as described in FIG. 2 and are numbered accordingly. The walls 100 have a facing material 126 such as plywood, particle board, etc., through which a bullet will pass and then be contained when fired. To minimize the wear and tear on the trap, and on the facing material 126 in particular, a pair of portable traps 104 are disposed along the walls 100. Trap 104*a* is shown without a facing material and shows a generally hollow trap. Trap 104*b* has a facing material 178, such as plywood, particle board, plastic board, etc. covers the box 140 to provide a bullet trap similar to the trap formed by the walls of the shoot house. Trap 104*b* may also include a deceleration system within the trap which is discussed in detail below to further improve the deceleration of bullets. Trap 104*b* is also shown with steel arms 148*a*. Normally, the steel arms 148 would be covered with wood or some other material to inhibit ricochets.

A target 180 representing a person holding a gun is attached to the facing material 178. Thus, an officer or soldier entering the room should shoot at the target 180. When training a large number of officers, the majority of shots will hit the portable target, saving wear and tear on the larger and more expensive shoot house wall 100.

The portable targets 104 can also be used to ensure that an officer fires only in appropriate circumstances. Thus, for example, portable target 104*a* could be covered with a target representing a woman holding a cellular telephone. The officer will see a person holding a metal object, and must quickly determine that the person is not a threat. By repeat training, officers become skilled at making quick and accurate determinations about the threat posed. This protects the public from accidental shootings and protects the officer from being shot due to unnecessary delay in accessing the situation. Thus, both the public and the officer benefit from thorough training.

Because the targets 104*a* and 104*b* can be moved very easily, the situation can readily be changed so the officer does not become conditioned to the scenario. For example, target 104*a* can be moved immediately next to target 104*b* in a matter of seconds. Thus, on the next run through the shoot house, the officer must quickly determine the threat and shoot at the correct target without injuring the innocent bystander standing immediately adjacent the armed assailant.

As the trap 104*a* is moved to the other wall of the shoot house, it passes along a curved rail portion 164*a*. Because each trolley 152 is attached to one arm 148 and allows the hanger portion 160 to pivot with respect to the mounting portion 156, the trolleys easily navigates the curved portion 164*a*. Additionally, because the two trolleys 152 are attached to the arms 148 independent of each other, the same trolleys can be used with traps 104 of different widths.

The hooks 170 shown in FIGS. 2 and 3 are preferably configured to provide minimal obstruction. Thus, for example, the hooks 170 are spaced apart from each other and extend the rail beyond the wall 100 so that hooks can also be placed from the other side of the wall, thus providing rails 164 on both sides of the wall.

Figure 4:
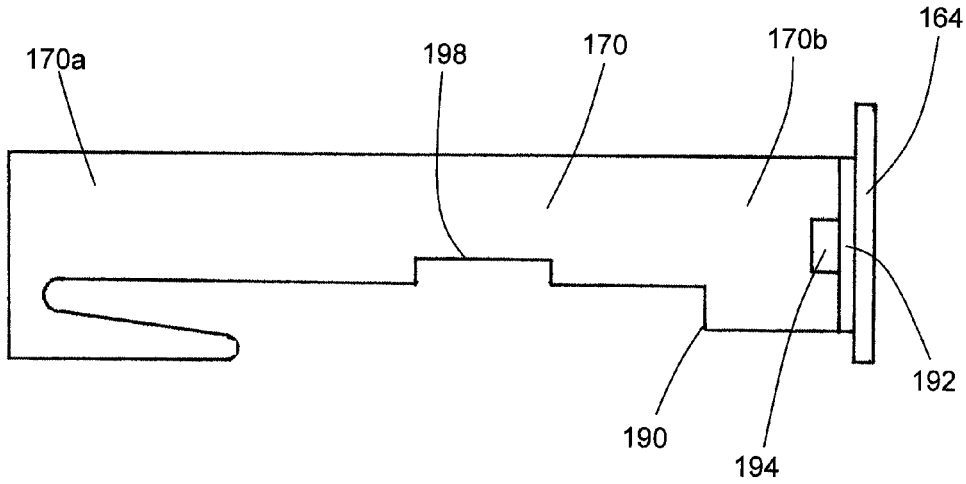
FIG. 4 shows a close-up view of a hook used to secure the rail system to the wall of the shoot house.

FIG. 4 shows a close-up view of one of the hooks 170. The hook 170 includes a first, U-shaped end 170*a* which is used to engage the opposing side of the cap piece 130 (FIGS. 2 and 3). The second, opposing end 170*b* includes a lip 190 which slides down over the front edge of the cap piece 130 and holds the hook 170 in place. The second end 170*b* also includes a flange 192 for attachment to the rail 164 by a bolt 194 or some other fastening mechanism. The hook 170 may also include a channel 198 so that the hook does not interfere with any nuts or bolts extending above the cap piece 130.

Figure 5:
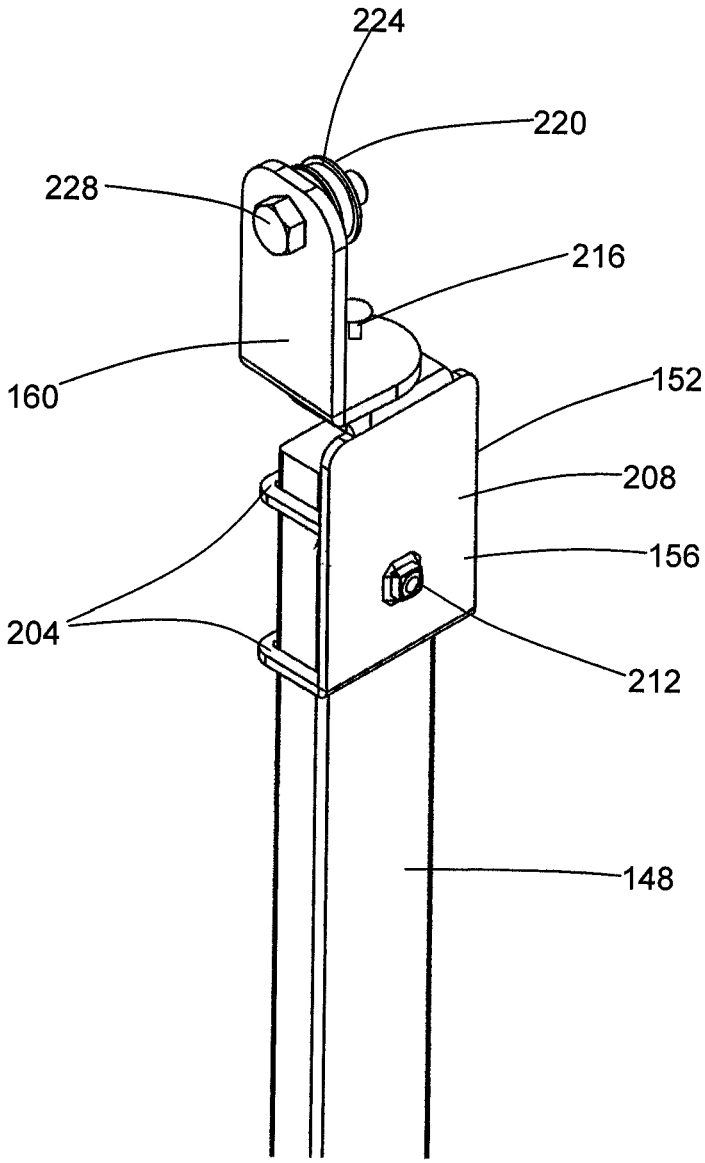
FIG. 5 shows a close-up view of the trolley which connects the portable bullet traps to the rail system.

FIG. 5 shows a close-up view of the trolley 152 is used to connect the portable bullet traps to the rail system. The trolley 152 includes the mounting portion 156 which is configured to receive an arm 148 attached to the portable trap (not shown). The mounting portion 156 includes one or more retaining members 204 and a base 208 for receiving the arm 148. The arm 148 is slid in place and then a bolt 212 or other fastener is tightened to hold the arm 148 in place. While the mounting portion 156 receives the arm 148, the hanger portion 160 is attached to the mounting portion 156 by a rotating or pivot member 216 such as a bolt, rivet, spring, etc., which allows the hanger portion to rotate or pivot with respect to the mounting portion. This allows the trolley(s) 152 to follow any curves in the rail.

The hanger portion 160 also includes a wheel 220 or other structure which allows the handle portion to slide or roll along the rail. To facilitate engagement with the rail, the wheel 220 may include an annular groove 224. Additionally, the wheel 220 may be held to the remainder of the hanger portion 160 by a bolt 228, a rivet, or other structure.

Figure 6A:
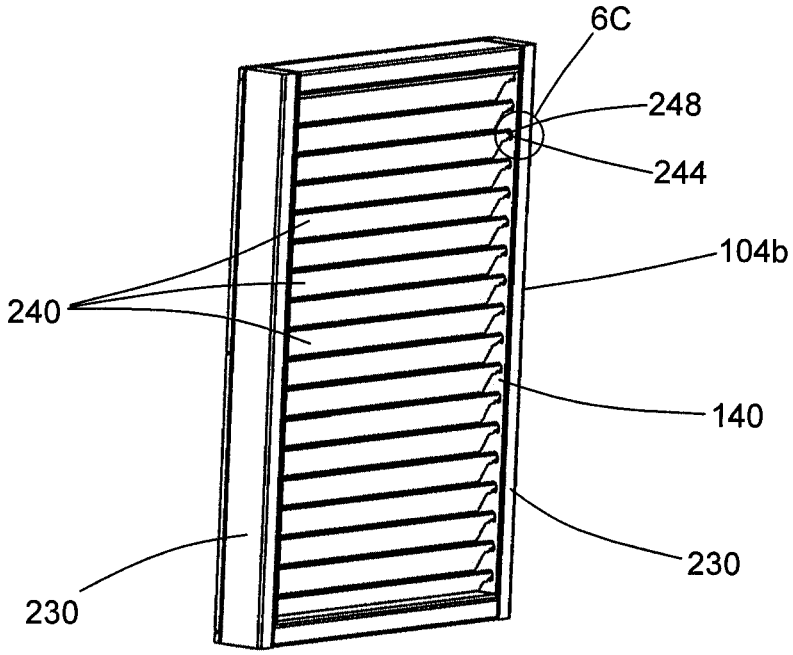
FIG. 6A shows a perspective view of the interior of one of the bullet traps of FIG. 3.

FIG. 6A shows a perspective view of the interior of the bullet trap 104*b* of FIG. 3. The bullet trap 104*b* includes a bullet proof box 140, i.e. a frame with a back plate which is open in the front. On either side of the frame, wood two-by-fours 230 are placed to prevent ricochets. Unlike bullet trap 104*a* in FIG. 3, the box 140 is not empty. Rather, a plurality of pivotable baffles 240 is provided. The baffles 240 engage a plurality of openings, such as opening 244 in FIG. 6C, which are formed in the sides of the box 140.

Figure 6B:
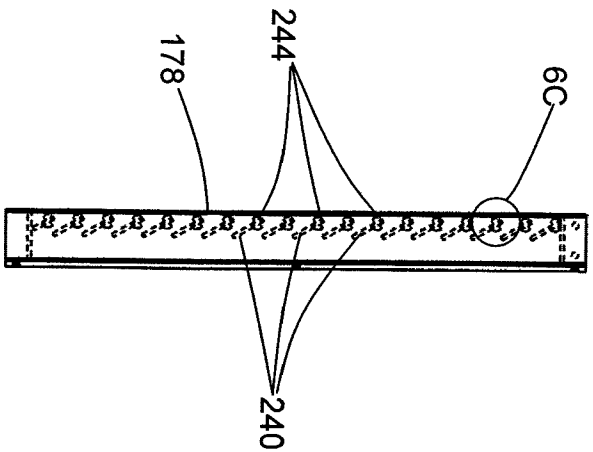
FIG. 6B shows a side view of a wall of the bullet trap shown in FIG. 6A.

The openings 244 receive an arm 248 from the baffle 240. As shown in FIG. 6B, the arms 248 of the baffles 240 engage the openings 244 so that the baffles hang, preferably at an angle between vertical and 80 degrees from vertical. More preferably, the baffles 240 hang at an angle of between about 15 degrees and 60 degrees from vertical. Ideally, the baffles 240 hang between about 20 degrees and 45 degrees from vertical. The range of movement of the baffles 240 is controlled by forming the openings or holes 244 with stops 252*a* and 252*b*, which limit the rotation of the arm 248 to a desired amount in either direction.

As a bullet passes through the facing material 178, the bullet will impact one of the baffles 240. Contacting the baffle 240 has two effects. First, some of the energy of the bullet is consumed pivoting the baffle upwardly from the hinge formed by the arm 248 and the opening 244. Second, impacting the baffles 240 will cause the bullet to deflect slightly, i.e. 5 to 20 degrees, prior to impacting the plate at the back of the box 140. In most situations, shoot houses are not used with high powered rounds because the round tends to damage the plate when it impacts it at close to a 90 degree angle. It has been found, however, that deflecting the bullet even slightly off its original path significantly reduces damage to the plate. By absorbing some of the energy with the pivoting baffle 240, a high power round can be used with virtually no damage to the steel. If, on rare occasion the round were to damage the baffle 240, the baffle can be replaced easily and at a much lower expense than replacing the trap 104*b*.

Figure 6C:
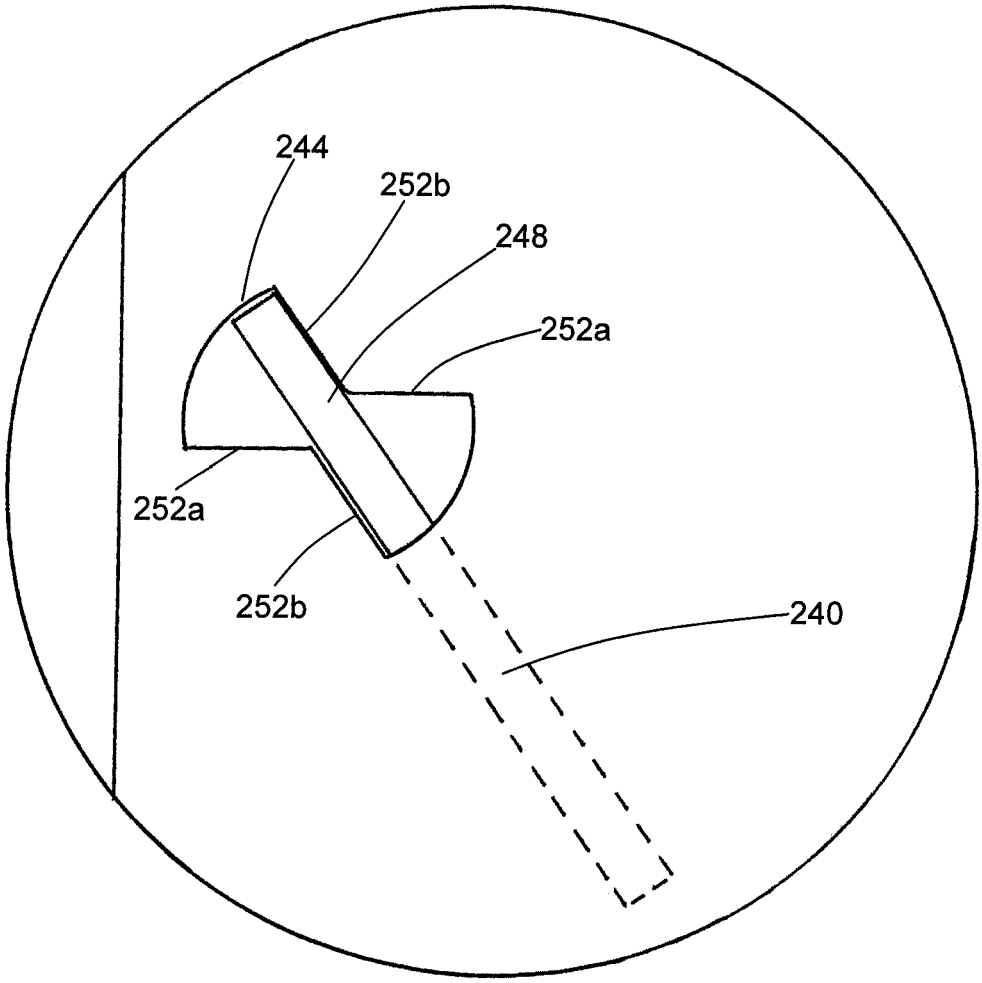
FIG. 6C shows a close-up view of the hinge of one baffle shown in FIG. 6A.
Figure 6D:
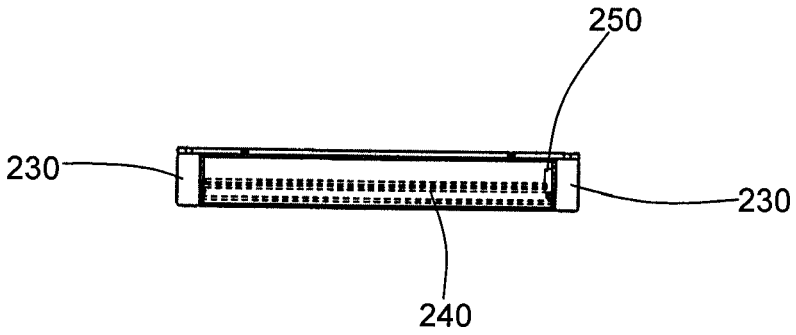
FIG. 6D shows a top view of the bullet trap of FIG. 6A.

FIG. 6D shows a top view of the bullet trap of FIGS. 6A-6C. The arms 248 of the baffles 240 extend outwardly sufficiently to engage the openings. They are preferably sized, however, so that a baffle 240 can be removed by simply pushing the baffle to one side until the arm 248 on the opposing side slides out of the opening. The baffle 240 can then be replaced, etc. To prevent an arm 248 of the baffle 240 from being inadvertently removed from the opening 244, a retaining bar 250 may be placed in the housing to prevent the baffle from being slid in one direction. In such a configuration, one arm 244 will typically be longer than the other. When a baffle 240 needs to be replaced, the retaining bar 250 is moved out of the way and the baffle slid until one arm and the opening 244 are no longer in engagement. The baffle 240 can then be removed from the frame.

It will be appreciated that the baffle mechanism shown in FIG. 6A-6D can also be incorporated into a shoot house wall as well. For example, a pair of plates with holes could be attached to the two-by-fours of the bullet containment mechanism. The baffles could then be disposed in the holes so that baffles are positioned between the facing material and the metal plates. In such a manner, a shoot house can be made with facilitates use with high powered rounds.

Figure 7:
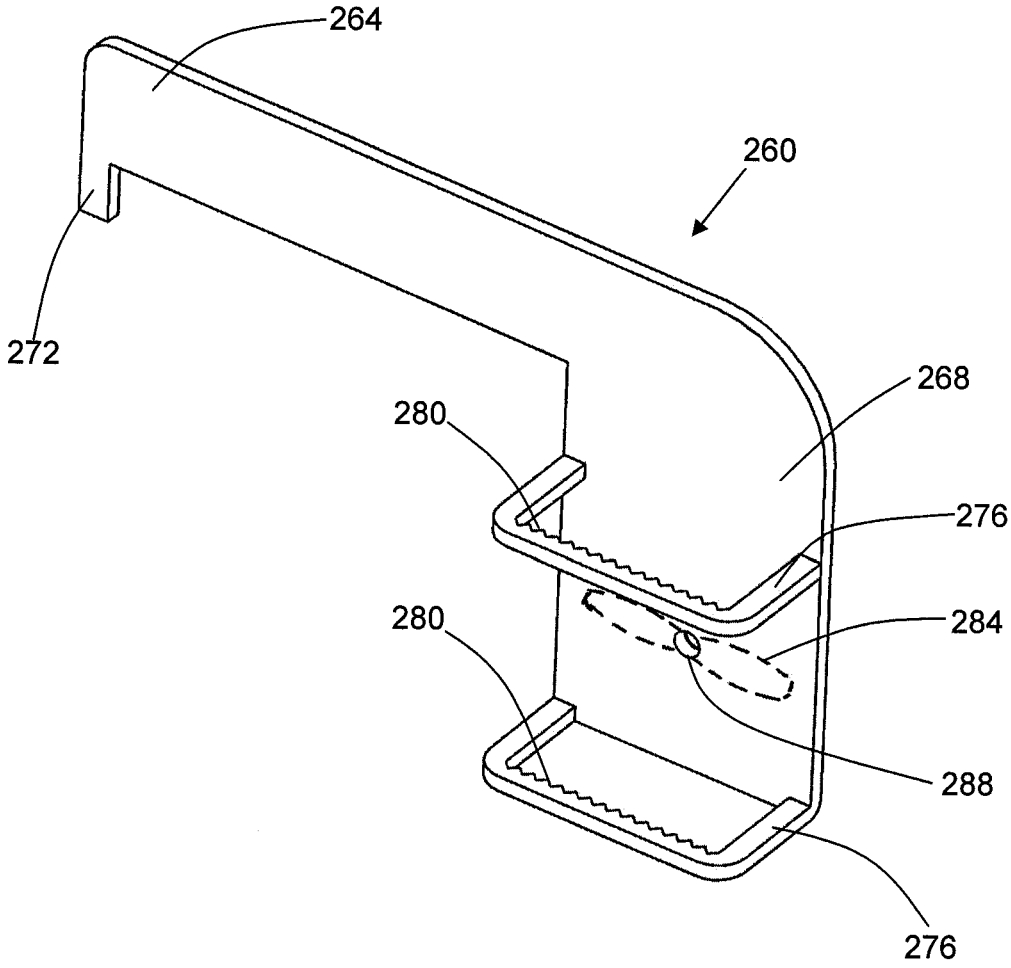
FIG. 7 shows a perspective view of yet another hanger for holding a portable bullet trap.

FIG. 7 shows a perspective view of yet another hanger, generally indicated at 260, for holding a portable bullet trap. Unlike the trolley discussed above, the hanger 260 is not designed to slide along the rail (although it could be modified to do so by adding a wheel or low friction slidable material). Rather, the hanger 260 is provided with a hook portion 264 configured to engage the shoot house wall, typically along the cap piece, and a mounting portion 268 which is configured to receive the arm of a portable target. The arm portion 264 includes a lip 272 which engages the back side of the cap piece to ensure a secure hold. The weight of the portable trap will pull the hanger 260 downwardly so that the cap piece nests between the lip 272 and the mounting portion 268.

The mounting portion 268 includes a pair of retaining members 276 which engage the arm of the portable trap. As shown in FIG. 7, the retaining members 276 have a plurality of protrusions 280 which are configured to dig into the wood arm of the bullet trap to thereby ensure a secure grip. (It will be appreciated that the retaining members shown in FIG. 5 may also include protrusions or other mechanisms to increase grip).

Disposed on one side of the mounting portion 268 is a fastener, such as a wing bolt 284, which extends through an opening 288 in the mounting portion to engage the portable trap arm and press it against the retaining members 276. One advantage of the present configuration is that it allows the height of the portable trap to be adjusted. By loosening the fastener, i.e. wing bolt 284, the arm can be slid up and down along the mounting portion 268. Thus, the arm could be long enough to place the bullet trap near the floor in one scenario (representing an assailant in a prone position) and then the bullet trap raised to slightly above the middle of the wall to represent a person standing up. This is accomplished by simply loosening the wing bolt 284, sliding the bullet trap into a new position, and retightening the wing bolt.

It will be appreciated that the mounting portion 268 shown in FIG. 7 could be used in conjunction with the trolley discussed above. In such a scenario, the bullet trap would extend out from the wall a few inches, or the rail could be moved rearwardly so that it is positioned above the cap piece, with the hanger portion extending to the rail.

Figure 8A:
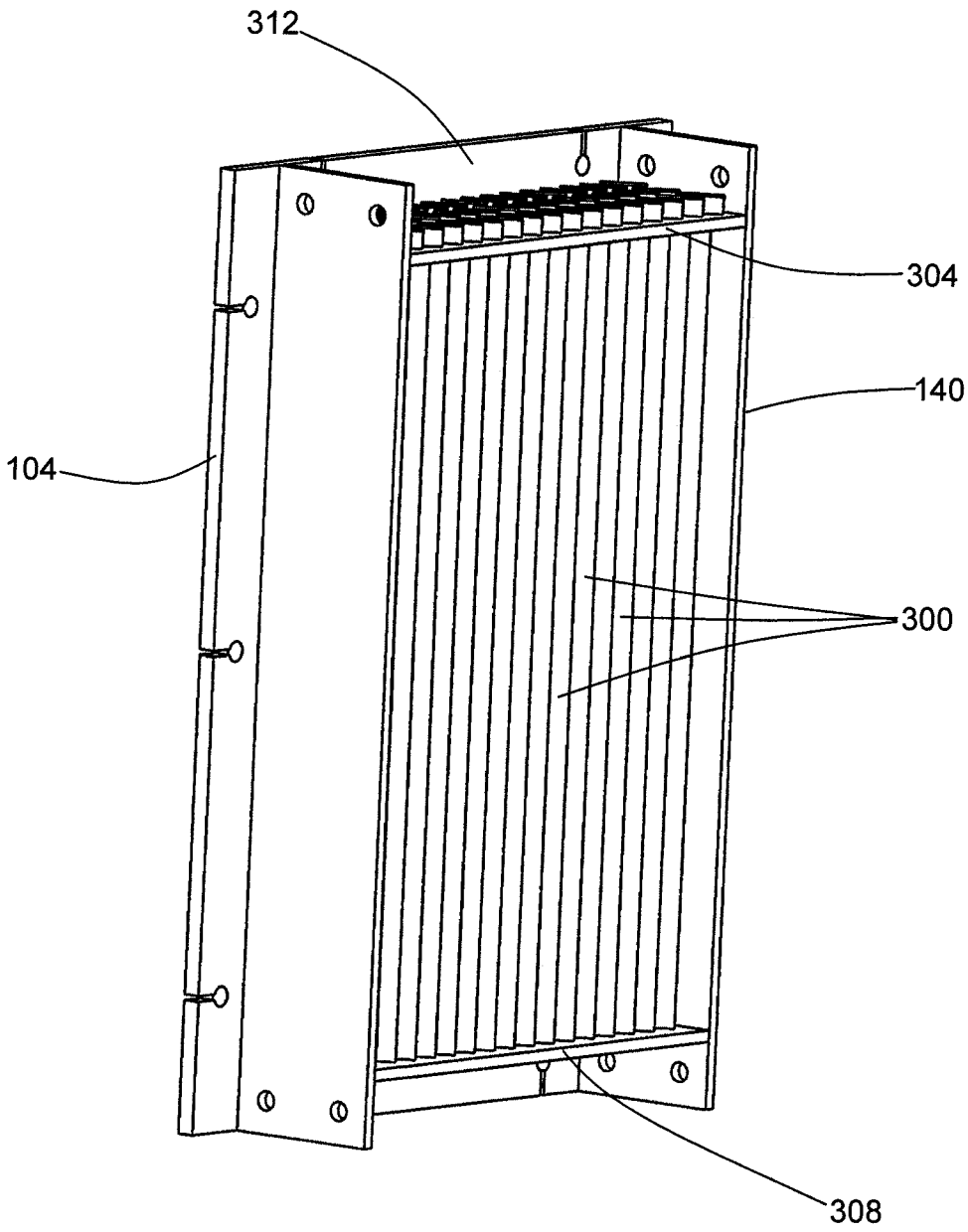
FIG. 8A shows a perspective view of the interior of one of the bullet traps of FIG. 3.

FIG. 8A shows another perspective view of an interior of a bullet trap of FIG. 3. The bullet trap 104 is formed and used in the manner shown in FIGS. 2 and 3. The bullet trap 104 includes a bullet proof box 140 which typically includes a frame and back plate with an open front. Bullets enter through the front and are contained within the box 140. The box 140 includes a plurality of hanging metal objects 300. The objects 300 may be strips of steel plate, etc. The hanging metal objects 300 are typically attached to or suspended from the top 304 of the box 140. The hanging metal objects 300 may also be attached to the bottom 308 of the box 140, or may swing freely or to a limited degree at the bottom of the box to be deflectable when hit by a bullet. The hanging metal objects 300 prevent a direct pathway from the front of the box (which typically includes a plywood or similar facing material 178 (FIG. 3) and a target) to the back of the box. A bullet entering the box 140 will be deflected one or more times as it collides with the hanging metal objects 300 and thus lose energy, be deformed, and change trajectory. Thus, the hanging metal objects 300 allow the box 140 to contain high velocity bullets without requiring the use of overly thick steel to form the box 140.

Figure 8B:
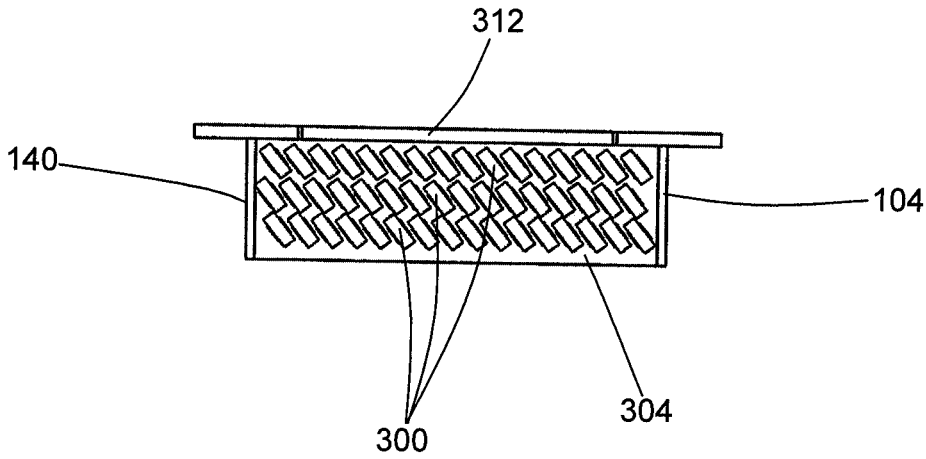
FIG. 8B shows a top view of the bullet trap of FIG. 8A.

FIG. 8B shows a top view of the bullet trap 104, illustrating a possible arrangement of the hanging metal objects 300. It can be appreciated that the arrangement of rectangular metal objects 300 shown will deflect a bullet one or more times before the bullet strikes the back 312 of the box 140. Each impact will remove energy from the bullet and significantly reduce the likelihood that the bullet could pass through the back plate 312. A number of holes may be formed in the top 304 of the box 140 to position the hanging metal objects 300.

These holes would control the spacing and positioning of the objects 300. Alternatively, the objects 300 may be attached to the top plate 304.

Thus there is disclosed a movable bullet trap that allows improved movement and adaptability of portable bullet traps in shoot houses and other similar environments. Those skilled in the art will appreciate that numerous modifications can be made to the configurations discussed herein without departing from the scope and spirit of the invention. The appended claims are intended to cover such modifications.

What is claimed is:

1. A portable bullet trap system comprising:

a portable bullet trap comprising a containment area and at least one arm for holding the containment area;

at least one trolley configured to engage the arm and configured to engage and move along a rail;

wherein the portable bullet trap comprises a plurality of baffles;

wherein at least one baffle of the plurality of baffles is pivotably mounted so that the at least one baffle is moved when struck by a bullet;

wherein the portable bullet trap system comprises a frame having a plurality of openings formed therein, and wherein the plurality of baffles each comprise a baffle arm for nesting in and rotating in one of the openings; and wherein the opening is shaped to limit the rotation of the baffle arm.

2. A portable bullet trap system comprising:

a portable bullet trap comprising a containment area and at least one arm for holding the containment area;

at least one trolley configured to engage the arm and configured to engage and move along a rail, further comprising a rail removably attachable to a wall, wherein the trolley comprises a mounting portion for receiving the at least one arm and a hanger portion configured to roll along the rail, wherein the rail is attached to a plurality of hooks, and wherein the plurality of hooks are configured for engaging a cap piece of a shoot house.

3. A portable bullet trap system of claim 2, further comprising a plurality of baffles disposed in the containment area.

4. A portable bullet trap system of claim 3, wherein at least one baffle of the plurality of baffles is pivotably mounted so that the at least one baffle is moved when struck by a bullet.

5. A portable bullet trap system of claim 4, wherein the portable bullet trap system comprises a frame having a plurality of openings formed therein, and wherein the plurality of baffles each comprise a baffle arm for nesting in and rotating in one of the openings; and wherein the opening is shaped to limit the rotation of the baffle arm.

6. The portable bullet trap system of claim 3, wherein the plurality of baffles are disposed substantially in parallel.

7. A portable bullet trap system of claim 3, wherein the plurality of baffles are removable.

8. A portable bullet trap system of claim 6, wherein at least one baffle of the plurality of baffles is pivotably mounted so that the at least one baffle is moved when struck by a bullet.

9. A portable bullet trap system of claim 7, wherein the portable bullet trap system comprises a frame having a plurality of openings formed therein, and wherein the plurality of baffles each comprise a baffle arm for nesting in and rotating in one of the openings; and wherein the opening is shaped to limit the rotation of the baffle arm.

10. The portable bullet trap system of claim 3, wherein the plurality of baffles are disposed substantially in parallel.

11. A portable bullet trap system comprising:

a portable bullet trap comprising a containment area and at least one arm for holding the containment area;

at least one trolley configured to engage the arm and configured to engage and move along a rail, further comprising a rail removably attachable to a wall, wherein the trolley comprises a mounting portion for receiving the at least one arm and a hanger portion configured to roll along the rail, wherein the rail is attached to a plurality of hooks, and wherein the plurality of hooks are mounted to a cap piece of a shoot house with a toolless mounting.

12. A portable bullet trap system of claim 11, further comprising a plurality of baffles.

13. A portable bullet trap system of claim 12, wherein the plurality of baffles are removable.

14. A bullet trap comprising:

a piece of bullet proof plate; and a plurality of pivotable baffles disposed in front of the piece of bullet proof plate, the plurality of pivotable baffles being configured to deflect when struck by a bullet;

wherein the trap comprises a frame comprising a plurality of generally bullet proof walls, and a plurality of openings formed in the walls for receiving a portion of the plurality of pivotable baffles.

15. The bullet trap of claim 14, wherein openings are shaped to provide stops which limit pivoting of the baffles.

16. The bullet trap of claim 14, wherein each baffle has a pair of arms extending therefrom, the arms nesting in the openings so as to form a hinge.

17. A method for decelerating a bullet, the method comprises:

forming a bullet trap having a piece of plate steel; and disposing in front of the piece of plate steel a plurality of pivotable baffles, such that the baffles pivot when struck by a bullet prior to the bullet striking the piece of plate steel, wherein the method comprises disposing a plurality of walls generally perpendicular to the piece of plate steel, the plurality of walls having holes formed therein, and further comprising positioning a portion of the baffles in the holes such that the holes allow pivoting of the baffles within a desired range.

18. The method according to claim 17, wherein the method comprises selecting walls with holes which are shaped to limit the rotation of the baffles.

* * * * *